United States Patent [19]

Korenowski

[11] 4,164,456

[45] Aug. 14, 1979

[54] ELECTROLYTIC PROCESS

[75] Inventor: Theodore F. Korenowski, Branford, Conn.

[73] Assignee: Dart Industries Inc., Los Angeles, Calif.

[21] Appl. No.: 916,328

[22] Filed: Jun. 15, 1978

[51] Int. Cl.[2] ..... C25D 3/38; C25D 3/12; C25D 3/22; H01M 4/04

[52] U.S. Cl. ..... 204/52 R; 204/48; 204/49; 204/55 R; 204/108; 429/106

[58] Field of Search ..... 429/106; 204/108, 48–55, 204/105 R, 108, 112, 119

[56] References Cited

U.S. PATENT DOCUMENTS

| | | | |
|---|---|---|---|
| 628,739 | 7/1899 | Baines | 429/106 |
| 2,814,589 | 11/1957 | Waltz | 204/37 |
| 3,253,955 | 5/1966 | Clampitt et al. | 429/11 |
| 3,915,818 | 10/1975 | Tributsch et al. | 204/105 R |
| 3,964,901 | 6/1976 | Swinkels et al. | 204/108 X |
| 3,984,295 | 10/1976 | Kametani et al. | 204/107 |

*Primary Examiner*—F. C. Edmundson

*Attorney, Agent, or Firm*—Margareta LeMaire; Bryant W. Brennan

[57] ABSTRACT

The limiting current density is increased without detrimentally affecting the quality of the metal deposit in an electrolytic process employing an electrolyte containing a dissolved metal sulfate, by adding sufficient quantities of the metal sulfate in a particulate state to maintain a solids concentration of the metal sulfate in the electrolyte during the electrodeposition.

12 Claims, No Drawings

ELECTROLYTIC PROCESS

BACKGROUND OF THE INVENTION

Mineral acid such as sulfuric acid solutions are used to dissolve metals in cleaning operations such as in pickling or in etching of metals, to bring out designs or remove unwanted metal, in deburring operations and in electropolishing. Such acid solutions as employed usually have fast metal dissolution rates and as the metal concentration increases, the solution reaction becomes progressively slower, such that further use of the solution becomes uneconomical relatively quickly. Dumping of such a spent solution is not only a pollution hazard, but is wasteful from the standpoint of the acid as well as the metal content.

In the past, crystallization is one technique that has been used to regenerate the solutions by removal of metal values from the solution as the corresponding metal salt of the mineral acid. Specifically, the spent solutions from the metal treating operations which are carried out at elevated temperatures typically in the range of 100° F. to 180° F., are cooled sufficiently e.g., to a temperature in the range of 60° F. to 100° F., to produce a dilute crystal slurry, which subsequently is subjected to a separation step for removal and recovery of metal salt crystals. Although in some cases there is a ready market for these metal salts without any further treatment being required, perhaps except for a drying step, it is usually economically attractive to dissolve the salts in a dilute hot acid and then recover metal values as pure metal in an electrolytic plating cell from the acidic electrolyte.

Another method used with some advantage in the prior art is the direct electrolysis of acidic spent metal treatment solutions without prior crystallization, whereby metallic deposits are recovered from the cathodes and the metal depleted electrolyte is returned to the metal treatment process as regenerated treatment solution.

It is well known that all electrolytic metal recovery processes are limited, insofar as the applicable current density is concerned, by the rate with which the metal ions are diffused from the electrolyte into the liquid film layer adhering to the cathode surface. The higher the metal deposition rate on the cathode, and thus the higher the depletion rate of metal ions from the cathode film, the more this limitation affects the current efficiency and the quality of the deposits. Specifically, when the rate of ion removal from the cathode film for deposit onto the cathode surface exceeds the diffusion rate of metal ions from the electrolyte into the cathode film for replenishment, a situation is rapidly reached, where a considerable portion of the current is made available for hydrogen deposition rather than metal deposition. Under these conditions, the metal ions will plate on the cathode in an erratic manner, which leads to dentritic structure, treeing of the deposits, poorly adhering coatings of insufficient thickness, and clogging of the electrolytic cell by powdery material falling off the cathodes even to the extent of shorting current flow through the electrolyte.

It is apparent from the above that there is a maximum or "limiting" current density that can be used in any particular electrolytic system for deposits of metal of acceptable quality and thickness. Since for any given plating capacity the limiting current density directly affects the size requirements of the electrodes and, therefore, the capital cost of the entire electrolytic cell, it follows that any practical improvement which serves to increase the limiting current density without adding significant further costs would be highly desirable.

Generally, it has been recognized that the aforementioned diffusion rate decreases with increasing cathode film thickness, and, therefore, any method that results in reduction in film thickness, and, therefore, any method that results in reduction in film thickness has heretofore been considered as the best approach of increasing the limiting current density. Agitation, i.e., a rapid movement of either the electrodes or the electrolyte relative to each other is most helpful in this respect. For the agitation to be meaningful, the movement should be of relatively high velocity and act parallel to the electrode surface with a minimum of turbulance. Various methods of agitation have been suggested and used with limited success including mechanical movement by rotation or reciprocation of the electrodes in a relatively stagnant electrolyte pool, as well as movement of the electrolyte past stationary electrodes achieved by a recirculating solution pumping system, or circulation of air through the electrolyte.

However, in commercial size operations requiring large electrode surface areas and large inventories of electrolyte in the system, it has not been economically feasible to provide the power requirements necessary to achieve a sufficiently high and uniform velocity of the electrolyte past the cathode surfaces in order to substantially eliminate the cathode film layer over the entire cathode surface. Therefore, on a commercial scale, the use of agitation in any of the prior art processes has not been as beneficial as would have been desired, and there still exists a need for a practical method that will increase the diffusion rate and thereby the limiting current density.

It is therefore an object of the present invention to provide an improved process for electrodeposition of metal of acceptable quality wherein the electrodeposition can be carried out at relatively high levels of current densities.

Another object of the invention is to provide an improved process for the regeneration of spent sulfuric acid metal treatment solutions and recovery of metal values for such spent solutions.

Further objects will become apparent from a reading of the detailed description of the invention and the appended claims.

THE INVENTION

It has now been found that in a metal electrodeposition process employing cathode and insoluble anode means wherein a metal is deposited onto a cathode from an electrolyte containing a dissolved metal sulfate, which provides a metal ions to be deposited on the cathode surface, the limiting current density can be increased without detrimentally affecting the quality of the metal deposit, when sufficient quantities of the metal sulfate in a particulate state is added to maintain a solid concentration of such particulate metal sulfate in the electrolyte during the electrodeposition, while providing agitation to suspend the metal sulfate solids in the electrolyte and to provide intimate contact of the resulting suspension with the cathode surface.

There are two main causes for the improvement in diffusion rate. One of these is the increased driving force which is provided by maintaining the electrolyte at all times at maximum saturation of the metal ions especially in the immediate vicinity of the cathode surface. This is in contrast to what occurs in prior art processes, where, as a result of the plating action at the desired conditions of non-turbulent, linear flow of the electrolyte past the cathode surface, the electrolyte is continuously being depleted in the metal ions. Even if fresh feed electrolyte saturated in metal ions were to be supplied to said prior art processes at a rate commensurate with the rate of plating, there would be no point within the electrolytic cell where the electrolyte approaches saturated conditions due to the dilution of the fresh feed with the recirculating non-saturated inventory of electrolyte. The other reason for the improvement in diffusion rate is the abrasive action provided by the solids, which action aids in decreasing the cathode film thickness.

No special precautions need to be taken with regards to the addition of the metal sulfate solids, which can be added directly to the cell either in dry form or as a crystal slurry. During the course of the operations, it will generally be necessary to add further quantities of metal sulfate solids to insure that the electrolyte be maintained automatically at the saturation level of the metal ions and that there is a continuous source for replenishment of metal ions removed by the electrodeposition process. These further additions can be made either on an intermittent or continuous basis.

The particulate metal sulfate is advantageously added to the electrolyte in quantities sufficient to maintain a solids concentration between about 5 and about 60 volume percent, and preferably between about 15 and about 40 volume percent. These concentrations are determined at fully settled conditions, e.g., by allowing a small test sample of the electrolyte slurry to settle in a graduate.

Since in addition to the production of elemental metal, the process results in increases in electrolyte volume and free sulfuric acid concentration, steady state conditions are maintained by removing a portion of the liquid electrolyte, thereby withdrawing free sulfuric acid at a rate which is commensurate with the production thereof. In order to maintain the acid concentration of the electrolyte in the desired range during the process, water must be added to the cell. Advantageously, the aforementioned water needed for steady state conditions is provided at least in part by the addition of the solids as a dilute acid slurry.

Metals which are particularly suited for electrodeposition by the process of this invention include copper, nickel, cobalt and zinc. Conventional operating conditions are employed including free sulfuric acid concentrations in the liquid phase of the electrolyte suspension typically ranging from about 50 to about 500 grams/liter. The process can be operated at temperatures ranging from about 50° F. to about 200° F.

The electrodeposition can be carried out in any electrolytic cell having provision for agitation to suspend the solids throughout the liquid phase. In large scale operations, it is advantageous to additionally provide a motion of the electrolyte slurry relative to and parallel with the electrode surfaces using any suitable prior art technique, e.g., those hereinbefore described. However, particular economical advantages are obtained, when employing the electrolytic cell disclosed in concurrently filed U.S. application Ser. No. 916,327, issued as U.S. Pat. No. 4,139,429 incorporated herein as part of the disclosure. Briefly, this cell features a cell tank having two arcuate end walls, an impeller disposed within the tank adjacent to each end wall providing internal recirculation of the slurry electrolyte, and flow directional baffle arrangements for apportioning and guiding the electrolyte into the channels between the electrodes of each of two electrode assemblies. These assemblies are positioned on each side of a central baffle parallely therewith and with the side walls of the cell tank. In the bottom portion of the cell tank, there is a sparger arrangement which provides sufficient agitation to suspend the solids throughout the liquid phase of the electrolyte. In this cell, the velocity of the electrolyte slurry as it is moved in a parallel direction past the cathode surfaces is maintained between about 30 and about 300 ft./min. and preferably between about 60 and about 150 ft./min.

It has been found that by the use of the process of this invention significantly higher current densities can be applied under any given conditions without a sacrifice in quality of the plate deposits, i.e., current densities 3–4 times higher than conventional levels are typical. Due to the higher plating current densities the size requirement of the electrolytic cell is reduced, resulting in considerable savings in capital costs. Other savings in equipment and labor costs are realized because the metal crystal dissolving step and the plating are combined into one single operation. Also, since metal deposits of desirable quality can be achieved with good current efficiencies at relatively high current densities and ambient temperatures, the need for heating equipment is eliminated and energy consumption is reduced.

The process of this invention is generally useful in producing metal in elemental form from a slurry comprising solid metal sulfate and sulfuric acid. It is especially advantageous when integrated into an overall process scheme consisting of these major steps: (1) metal treatment with sulfuric acid solutions (e.g., pickling, etching, cleaning, etc.), (2) removal of excess metal from spent acid solution by crystallization and return of the metal depleted solution to the metal treatment step, and (3) recovery of elemental metal and free sulfuric acid values from the metal sulfate crystals formed in step (2). Free sulfuric acid and dissolved metal sulfate can be returned either to the crystallization step or directly to the metal treatment step, wherever most beneficial, taking into consideration such factors as differences in temperature and in soluble metal content between the respective solutions. Either way, because of the complete integration of the process steps, the regenerated sulfuric acid is ultimately returned to the metal treatment step.

In such an integrated system, pollution problems are obviated, no significant amount of metal values are lost from the system and a balance with respect to free sulfuric acid requirements is maintained to a great extent.

For a better understanding of the invention, the following examples are provided.

EXAMPLE 1

1500 ml of a copper sulfate-sulfuric acid slurry was prepared by adding copper sulfate pentahydrate crystals to an aqueous solution which contained 15 percent by volume sulfuric acid (66° Baumé) and was saturated with copper sulfate at 67° F. (29.2 g/l Cu). At rest, the volume of copper sulfate pentahydrate crystals comprised about 20 percent of the total slurry volume. The slurry was agitated in a 2 liter beaker with a mechanical stirrer and copper was electrolytically plated from this slurry at a cathode current density of 80 amps per square foot using a stainless steel cathode having a submerged electrode surface area of 0.12 square feet and lead anodes. During the plating period additional crystals were added so as to maintain the crystal volume in the range of about 5 to 25 percent of the total slurry volume. At the end of three hours of plating at a temperature of 70° F., the cathode was removed and inspected. It was found that the copper had plated in a smooth fine grained deposit at a current efficiency of 99.8 percent.

CONTROL EXAMPLE A

This plating test was conducted using the conditions of Example 1 except that the sulfuric acid solution was unsaturated in copper sulfate (10 g/l Cu), and no crystals were added to the electrolyte. During the course of the plating which was carried out with mechanical stirring at 70° F. for 4 hours, dissolved copper sulfate was added to maintain the copper concentration at about 10 g/l. The limiting current density was determined to be 20 amps/sq. ft. and the current efficiency was 92 percent.

CONTROL EXAMPLE B

In another comparative test carried out essentially as in Control Example A, with the exception that inert particulate solids representing about 20 percent of the total mixture (at fully settled conditions) was also added. These inert solids, which were crushed glass beads of about the same average particle size as the copper sulfate pentahydrate crystals used in Example 1 were added to provide an evaluation of the approximate magnitudes of the separate effects contributing to the superior results of Example 1. Thus in this example the effect of the scrubbing action of particulates in the agitated slurry on the cathode to reduce the cathode film could be assessed. It was found that the limiting current density was approximately 50 amps/sq. ft., which is higher than the value obtained in Comparative Example A, but lower than that of Example 1. The current efficiency was about 95 percent.

EXAMPLE 2

One liter of a copper sulfate-sulfuric acid slurry was prepared by adding copper sulfate pentahydrate crystals to an aqueous solution which contained 15 percent by volume free sulfuric acid (66° Baumé) and was saturated in copper sulfate at 67° F. (29.2 g/l Cu). Initially at rest, the crystal fraction comprised about 40 percent of the total slurry volume. This slurry was agitated mechanically and heated to 150° F. while copper was plated at a current density of 160 amps per square foot. A stainless steel cathode was used with lead anodes. After one hour of plating under these conditions, the cathode was removed and inspected. The copper deposit was relatively smooth and fine grained in nature.

Based on the weight of copper, the plating efficiency was found to be 100 percent.

Thus having described the invention in detail it will be understood by those skilled in the art that certain variations and modifications may be made without dpearting from the spirit and scope of the invention as described herein or in the appended claims.

What is claimed is:

1. In a metal electrodeposition process employing cathode and insoluble anode means immersed in a common electrolyte wherein metal is deposited onto a cathode surface from the electrolyte consisting essentially of water, free sulfuric acid and a dissolved metal sulfate, which dissolved metal sulfate provides the metal ions to be deposited on the cathode surface, the improvement of increasing the limiting current density without detrimentally affecting the quality of the metal deposit which improvement comprises:

adding sufficient quantities of the metal sulfate in a particulate state to maintain a solids concentration of the particulate metal sulfate in the electrolyte during the electrodeposition, providing agitation to suspend said metal sulfate solids in the electrolyte and to provide intimate contact of the resulting suspension with the cathode surface, and maintaining the free sulfuric acid concentration in the liquid phase of the electrolyte suspension between about 50 and about 500 grams per liter.

2. The process of claim 1, wherein the agitated suspension is moved in a direction, which is parallel with the cathode surface.

3. The process of claim 2, wherein the agitated suspension is moved at a velocity in the range from about 30 to about 300 ft./min. past the cathode surface.

4. The process of claim 3, wherein the velocity is in the range from about 60 to about 150 ft./min.

5. The process of claim 1, wherein the particulate metal sulfate material has been obtained in a previous crystallization step, in which a spent sulfuric acid metal treatment solution containing dissolved metal values is being regenerated for reuse in the metal treatment step by removal of metal sulfate generated in the crystallization, and wherein free sulfuric acid values generated in the electrodeposition is returned to the metal treatment step.

6. The process of claim 5, wherein the generated free sulfuric acid values are ultimately passed to the metal treatment step by introducing a portion of the electrolyte to the crystallization step.

7. The process of claim 5, wherein the generated free sulfuric acid values are returned by introducing a portion of the electrolyte directly to the metal treatment step.

8. The process of claim 1 wherein the solids concentration is maintained between about 5 and about 60 percent by volume, determined at fully settled conditions.

9. The process of claim 1, wherein the solids concentration is maintained between about 15 and about 40 percent by volume, determined at fully settled conditions.

10. The process of claim 1, wherein the electrodeposition is carried out at a temperature in the range from about 50° to about 200° F.

11. The process of claim 1, wherein the metal is selected from the group consisting of copper, nickel, cobalt and zinc.

12. The process of claim 1, wherein the metal is copper.

* * * * *